United States Patent [19]

Shoemaker

[11] Patent Number: 4,937,585

[45] Date of Patent: Jun. 26, 1990

[54] MICROWAVE CIRCUIT MODULE, SUCH AS AN ANTENNA, AND METHOD OF MAKING SAME

[75] Inventor: Kevin O. Shoemaker, Morrison, Colo.

[73] Assignee: Phasar Corporation, Lakewood, Colo.

[21] Appl. No.: 94,511

[22] Filed: Sep. 9, 1987

[51] Int. Cl.[5] ..... H01Q 1/38

[52] U.S. Cl. ..... 343/700 MS; 343/777; 343/853

[58] Field of Search ..... 343/700 MS, 754, 777, 343/778, 850, 853, 844

[56] References Cited

U.S. PATENT DOCUMENTS

| | | | |
|---|---|---|---|
| Re. 29,296 | 7/1977 | Krutslager et al. | 343/700 M S |
| Re. 29,911 | 2/1979 | Munson | 343/700 M S |
| 2,622,198 | 12/1952 | Clapp et al. | 343/801 |
| 2,874,276 | 2/1959 | Dukes et al. | 343/781 R |
| 2,990,548 | 6/1961 | Wheeler | 343/908 |
| 3,377,592 | 4/1968 | Robieux et al. | 342/429 |
| 3,400,405 | 9/1968 | Patterson, Jr. | 343/854 |
| 3,478,362 | 11/1969 | Ricardi et al. | 343/769 |
| 3,541,565 | 11/1970 | Fisler | 343/777 |
| 3,643,262 | 2/1972 | Dumanchin | 343/846 |
| 3,665,480 | 5/1972 | Fassett | 343/754 |
| 3,680,136 | 7/1972 | Collings | 343/746 |
| 3,713,162 | 1/1973 | Munson et al. | 343/705 |
| 3,753,162 | 8/1973 | Charlton | 333/24.1 |
| 3,775,769 | 11/1973 | Heeren et al. | 343/100 SA |
| 3,775,771 | 11/1973 | Scherer | 343/770 |
| 3,778,717 | 11/1973 | Okoshi et al. | 325/105 |
| 3,803,623 | 4/1974 | Charlot | 343/846 |
| 3,803,625 | 4/1974 | Nemit | 343/778 |
| 3,806,946 | 4/1974 | Tiuri et al. | 343/731 |
| 3,936,835 | 2/1976 | Phelan | 343/753 |
| 3,987,455 | 10/1976 | Olyphant | 343/829 |
| 3,995,277 | 11/1976 | Olyphant | 343/846 |
| 4,038,742 | 8/1977 | Kimball et al. | 29/600 |
| 4,083,046 | 4/1978 | Kaloi | 343/700 M S |
| 4,090,203 | 5/1978 | Duncan | 343/753 |
| 4,180,817 | 12/1979 | Sanford | 343/700 MS |
| 4,187,508 | 2/1980 | Evans | 343/770 |
| 4,371,459 | 2/1983 | Nazarenko | 252/514 |
| 4,414,550 | 11/1983 | Tresselt | 343/700 M s |
| 4,450,449 | 5/1984 | Jewitt | 343/700 MS |
| 4,464,663 | 7/1984 | Lalezari et al. | 343/700 MS |
| 4,614,947 | 9/1986 | Rammos | 343/778 |
| 4,623,893 | 11/1986 | Sabban | 343/700 M S |
| 4,635,062 | 1/1987 | Bierig et al. | 343/778 |
| 4,684,952 | 7/1987 | Munson et al. | 343/700 MS |

FOREIGN PATENT DOCUMENTS

| | | | |
|---|---|---|---|
| 1050583 | 1/1954 | France . | |
| 0798821 | 7/1958 | United Kingdom . | |
| 2131232 | 6/1984 | United Kingdom | 343/700 MS |

OTHER PUBLICATIONS

Karlson, I. of L. M. Ericsson, Report dated 3/21/80.

MSN, Mar. 1984, Ramos, E., "Suspended-Substrate Line Antenna Fits 12-GHz Satellite Applications".

R. Bancroft, "Conductive Ink a Match for Copper Antenna", Microwaves & RF, Feb. 1987, pp. 87-90.

*Primary Examiner*—Rolf Hille

*Assistant Examiner*—Doris J. Johnson

*Attorney, Agent, or Firm*—Curtis, Morris & Safford

[57] ABSTRACT

A microwave circuit module, more particularly an antenna, comprised of a polyethylene foam substrate having a loss tangent less 0.001 and a dielectric constant less than 1.3, a predetermined pattern of one or more elements, such as an array of n×m radiator elements, formed of electrically conductive material, deposited on a first surface of the substrate, and an electrically conductive ground plane secured to the opposite surface of the substrate. In the antenna embodiment, a feed network formed of electrically conductive material is deposited on said said first surface of the substrate for electrically interconnecting the radiator elements in the array; and I/O means are coupled to the feed network for supplying a signal to be transmitted by the antenna or for receiving a signal received by that antenna.

31 Claims, 6 Drawing Sheets

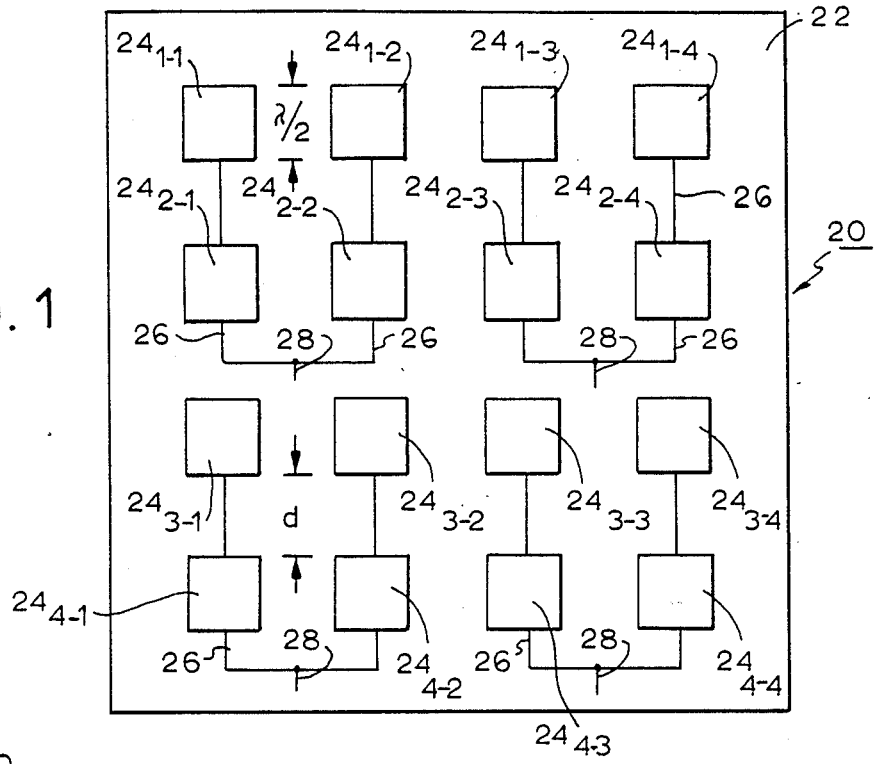
FIG. 1
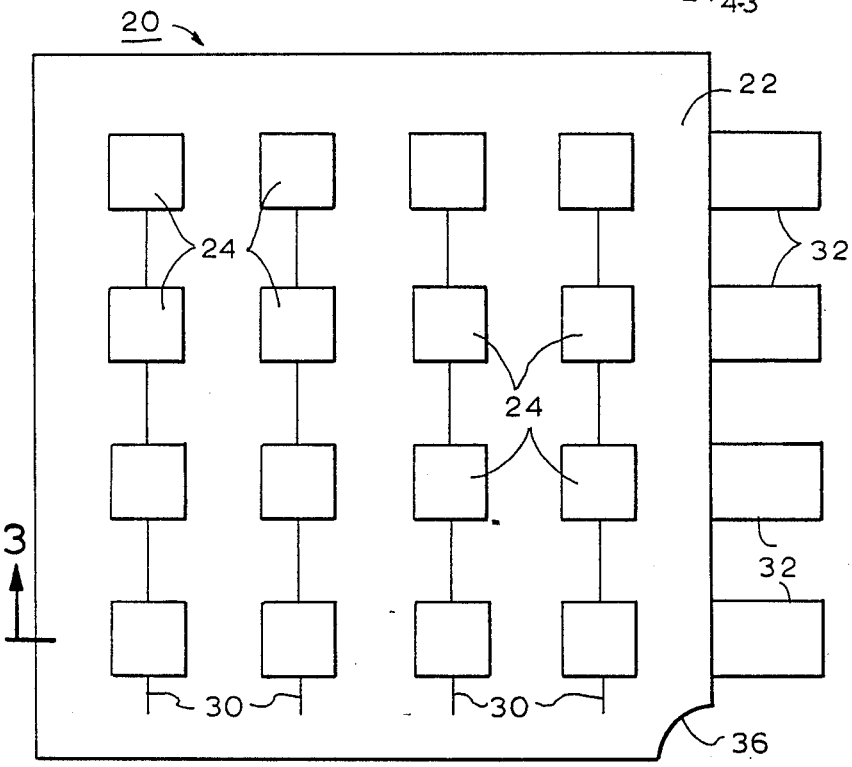
FIG. 2
FIG. 3
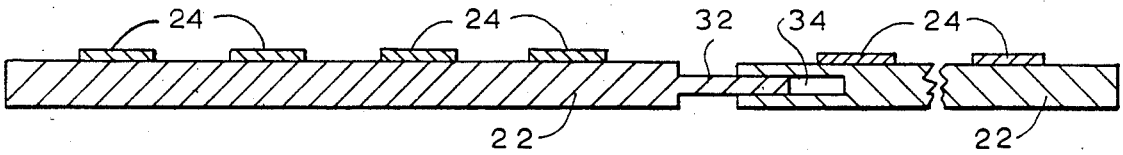

FIG. 6
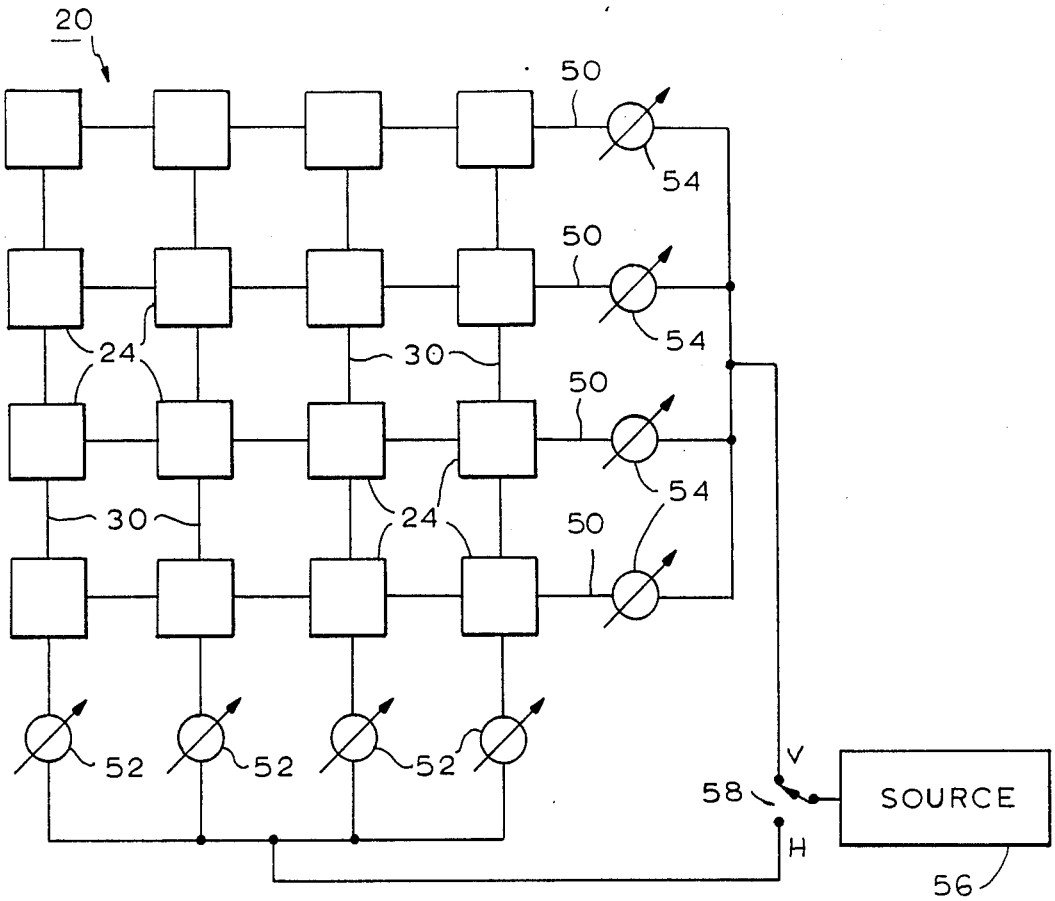
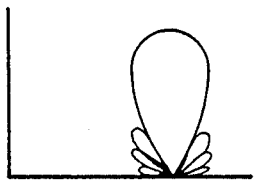
FIG. 6A
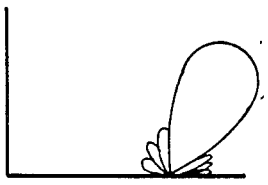
FIG. 6B
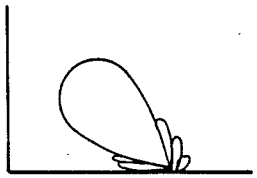
FIG. 6C
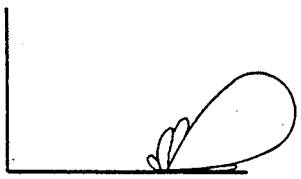
FIG. 6D FIG. 7
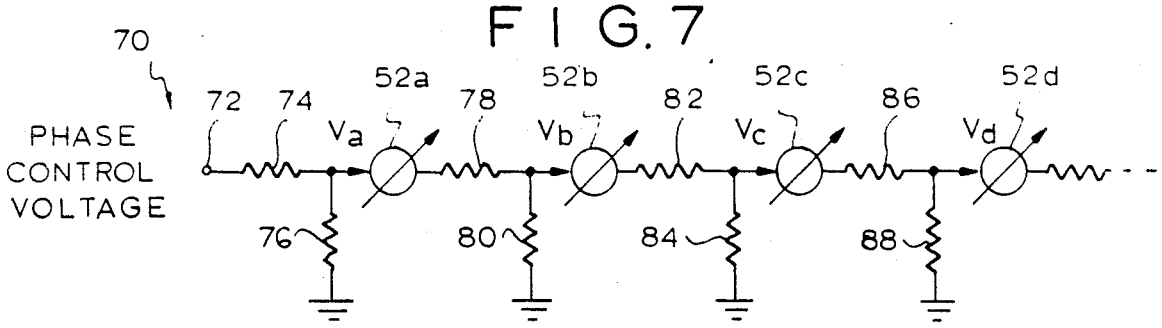
FIG. 8
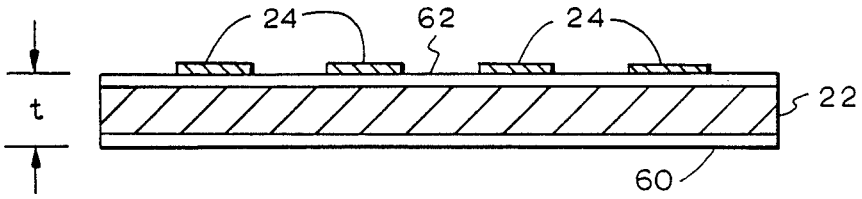
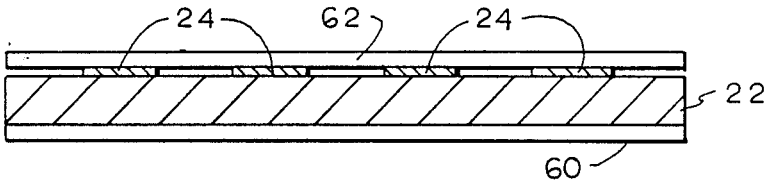
FIG. 9
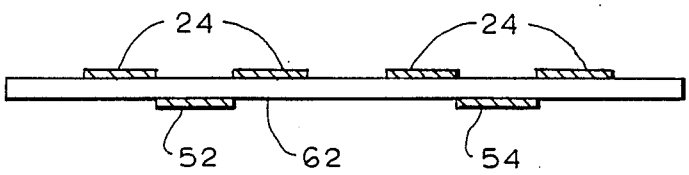
FIG. 10

MICROWAVE CIRCUIT MODULE, SUCH AS AN ANTENNA, AND METHOD OF MAKING SAME

BACKGROUND OF THE INVENTION

This invention relates to microwave circuit modules and, more particularly, to an antenna array that is relatively efficient, is relatively inexpensive to manufacture, may provide electronic beam steering, is relatively light in weight and may be more aesthetically pleasing than other kinds of antennas.

Phased array antennas are well known for transmitting and receiving microwave radiation for information communication. An early example of a phased antenna array is described in U.S. Pat. No. 2,622,198. An advantage to such phased antenna arrays is the relative ease in "steering" the beam transmitted or received by that array, thereby providing good directivity to improve the transmission/reception qualities of the antenna array. Such directionality of the microwave beam is controlled electronically and, thus, the antenna may be easily "steered" to a desired transmitting antenna. Such electronic beam steering of a phased antenna array is particularly useful in satellite communication.

Phased array antennas generally are relatively expensive; and the overall construction of such arrays has resulted in relatively heavy structures which are somewhat difficult to handle, assemble and position in desired locations at preferred sites. Consequently, it is desirable to form such antenna arrays of materials that would avoid these problems. Nevertheless, typical antenna arrays at the present time are still relatively expensive.

U.S. Pat. No. 4,038,742 describes a styrofoam slotted plane-array antenna. This antenna is formed of HD-300 styrofoam which has a loss tangent of approximately 0.0004 and a relative dielectric constant of 1.07. This styrofoam is a closed cell material which is easily machined to a relatively smooth surface. The antenna is formed by depositing a layer of copper on the surface of the rectangular waveguide section of the styrofoam and then forming separate sections by plating through holes which form short circuits within the resultant waveguide. The waveguide then has a series of radiating slots milled in one metallized surface so as to function as a phased array antenna. Separate sections formed in the aforementioned manner are bonded together to form a multi-section array. The manufacturing costs of combining the various sections of the waveguide and the amount of copper used make the cost of manufacturing the overall antenna array relatively expensive. Moreover, the antenna array is relatively heavy and bulky.

Reissue Pat. No. 29,911 describes a microstrip antenna in which an array of radiator elements, known as microstrip patches, are formed by etching away conductive material that coats one surface of a dielectric substrate. The opposite surface of this substrate has a conducting ground plane deposited thereon. RF feedlines interconnect the microstrip patches; and phase shifting arrangements are used such that the radiator elements emit circularly polarized radiation. Depending upon the particular shape of the patch and the manner in which the feedline is connected to that patch, different resonant frequencies and different polarizations can be attained. The resultant antenna can be used in the X-band; and it is believed that the teachings of this patent also are applicable to other conventional frequency bands. There is no clear disclosure in this patent of the structure or materials which constitute the aforementioned dielectric substrate.

So-called suspended strip line (SSL) antennas have been proposed for compact phased array antennas, as described in the March 1984 publication Microwave Systems News. The SSL antenna uses an SSL feed network; and the antenna has an open waveguide transition. According to this publication, the SSL antenna is composed of two metal plates, each with openings corresponding to the antenna elements, and the feed network includes a central conductor supported by a thin dielectric sheet. The SSL antenna achieves circular polarization by using two superimposed networks rotated 90° with respect to each other. The two orthogonal outputs are combined through a 3db hybrid coupler; and left-hand circular polarization as well as right-hand circular polarization can be achieved. Electronic beam steering is attained through an appropriate phase control in the feed network.

It also has been proposed in a report dated March 1980 by Ingmar Karlsson, of L. M. Ericsson of Sweden, to support an antenna by a foam whose thickness is about 0.15 meters and which is fed by a separate microstrip network. The antenna is formed of rectangular microstrip patches which are fed from behind and in parallel from the separate strip line network. According to this report, the microstrip feed network and the radiators can be etched on the same substrate. The report also describes an antenna in which the microstrip patches were etched on a thin GFRB substrate which was supported 14 mm above a ground plane by a low density Divinycell foam; and the microstrip feed network was etched on the other side of that foam. However, the requirement of etching the microstrip feed network and the microstrip patches adds significantly to the overall cost of this antenna.

It is believed that there has been a long felt need for an antenna, and more generally, for microwave components, which may be formed as lightweight structures and may be manufactured relatively inexpensively and quickly. The overall process of etching, as required in the aforementioned SSL antenna, the Karlsson report and Reissue Pat. No. 29,911 is expensive and time-consuming. It had been thought heretofore that the direct application of conductive patterns, forming radiator elements, feed networks, phase shifting circuits, and the like, on the surface of a low cost polyethylene foam, could not be achieved. Even if such conductive patterns could be deposited on such a foam, it had been thought that a satisfactorily operating antenna could not be formed thereby.

OBJECTS OF THE INVENTION

An object of the present invention is to provide an antenna array that is relatively inexpensive to manufacture, is of simple construction, is light in weight and may be expanded in modular form.

Another object of this invention is to provide an improved antenna array which may be used effectively and efficiently with satellite and other microwave communications.

A still further and more general object of this invention is to provide a novel construction for a microwave circuit module which, preferably, may be used in an antenna array.

Another object is to provide an antenna array built from microwave circuit modules.

An additional object of this invention is to provide a microwave circuit module formed of circuit elements which are printed on a polyethylene foam substrate.

Still another object of this invention is to provide a microwave circuit module formed of circuit elements which are otherwise deposited (but not etched) on a polyethylene foam substrate.

A still additional object of this invention is to provide an antenna array formed of radiator elements and a feed network printed or otherwise deposited upon a polyethylene foam substrate, and further including phase shifting elements for the purpose of electronically steering the antenna transmit/receive beam.

Another object of this invention is to provide an antenna array of the aforementioned type wherein the radiator elements are formed so as to effect circular polarization of the transmit/receive beam.

Various other objects, advantages and features of the present invention will become readily apparent from the ensuring detailed description, and the novel features will be particularly pointed out in the appended claims.

SUMMARY OF THE INVENTION

In accordance with this invention, a microwave circuit module is comprised of a polyethylene foam substrate having a loss tangent less than 0.001 and a relative dielectric constant less than 1.3, with a predetermined pattern formed of conductive ink (or conductive spray or epoxy) on one surface of the polyethylene foam substrate and an electrically conductive ground plane secured to the opposite surface of that substrate. In a preferred embodiment, the microwave circuit module is formed as an antenna array having modifiable, optimum electrical characteristics with the predetermined pattern formed as an array of $n \times m$ radiator elements coupled to a feed network, both the radiator elements and the feed network being deposited on one surface of the substrate, with the feed network being coupled to input/output (I/O) means for supplying a signal to be transmitted to or for receiving a signal from the array of radiator elements.

In accordance with one aspect of this invention, the polyethylene foam substrate is commercially available from, for example, Jiffy Packaging Company of Beverly, Mass., Halstead/Nomaco Company of Wynne, Ark., Sentinel Foam Products Company of Hyannis, Mass., Voltek Division of Sekisui America Corp., Lawrence, Mass., DuPont Corp. of Wilmington, Del., Foamade Industries of Auburn Hills, Mich., Dow Chemical Company of Midland, Mich., ARCO Chemical Company of Philadelphia, Pa., BASF Wyandotte Corp. of Parsippany, N.J., and Valcour, Inc. of Glens Falls, N.Y.

In accordance with another aspect of this invention, microwave circuit elements are deposited on a plastic layer; and the plastic layer is adhered to a surface of the substrate. In this embodiment, the plastic layer is selected from the group consisting of polyethylene, polypropylene, styrene, polyvinyl chloride, thermosetting polyester, saturated polyester, polyester with unsaturated acid components, polyester with unsaturated alcohol components, polycarbonate, diglycol carbonate and aromatic polyamides. The plastic layer may be a polyimide, such as available from DuPont Corp. as Kapton, or it may be an ethylene glycol terephthalic acid polyester, such as sold by DuPont under the trademark "Mylar".

As yet another feature of this invention, the microwave circuit elements are formed of electrically conductive ink. In this embodiment, the electrically conductive ink includes at least 40% by weight of a solid selected from the group consisting of copper, gold, silver, nickel and graphite. The electrically conductive ink includes a liquid selected from the group consisting of epoxy resin, polyurethane, acrylic and thermoplastic solvent.

As an alternative to printing the microwave circuit elements of electrically conductive ink, the radiator elements and feed network may be vacuum deposited on the substrate.

As yet another aspect of this invention, a switching circuit is used to couple the I/O means either to respective columns of the radiator elements or to respective rows of those elements. To provide circular polarization, the radiator elements may be configured, such as with a diagonal slit therein, such that circular polarization is accomplished.

As yet another feature of this invention, the I/O means includes phase shift circuits, at least a portion of each such circuit being deposited on the polyethylene foam substrate. In one embodiment, each phase shift circuit couples the I/O means to a respective column of radiator elements; thereby electronically steering the beam directivity of the antenna array merely by varying the phase shifts of such circuits by different amounts.

As an aspect of the aforementioned feature, phase shift circuits couple the I/O means to respective rows of the radiator elements to achieve further electronic steering of the beam directivity. For example, control over the column-connected phase shift circuits may achieve left/right (or horizontal) steering and control over the row-connected phase shift circuits may achieve top/bottom (or vertical) steering. Thus, by selectively connecting the I/O means to the column-connected or row-connected phase shift circuits, horizontal and vertical beam steering may be obtained.

In the embodiment wherein the radiator elements are mounted on a plastic layer that is adhered to the polyethylene foam substrate, the radiator elements and feed network preferably are deposited on one surface of that plastic layer and phase shift circuits are deposited on another surface thereof. Through conductors may be used to pass through the plastic layer for the purpose of connecting the phase shift circuits to the feed network.

As yet another aspect, plural antenna arrays may be interconnected to form an integral structure. That is, individual polyethylene foam panels may be used to support individual arrays; and these panels then may be interconnected to form the aforementioned integral structure.

BRIEF DESCRIPTION OF THE DRAWINGS

The following detailed description of the present invention, given by way of example and not intended to limit the invention solely to the embodiments described herein, will best be appreciated in conjunction with the accompanying drawings in which:

FIG. 1 is a schematic top view of one embodiment of the present invention;

FIG. 2 is a schematic top view of the modular capability of the present invention;

FIG. 3 is a sectional view taken along lines 3—3 of FIG. 2 and is intended to demonstrate the modular capability of the present invention;

FIG. 6 is a schematic representation of the beam steering ability of the present invention;

FIGS. 6A–6D are graphical representations of the beam directivity achieved by the embodiment shown in FIG. 6;

FIG. 7 is a schematic diagram of a phase shift control circuit;

FIGS. 8–10 are sectional views representing different embodiments from which the present invention may be constructed.

DETAILED DESCRIPTION OF CERTAIN PREFERRED EMBODIMENTS

Figure 4:
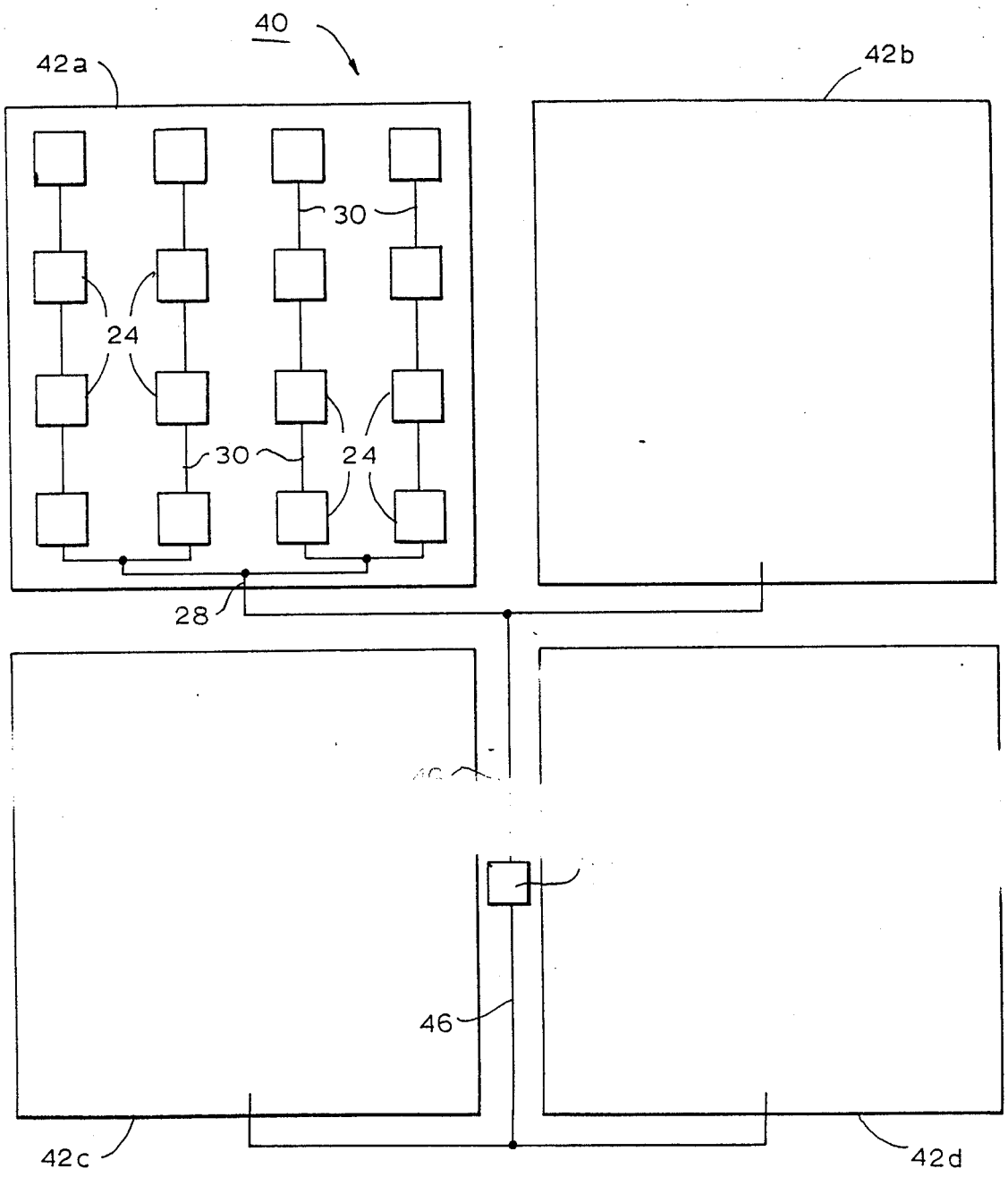
FIGS. 4 and 5 are schematic views of an integral antenna structure that is formed by the modularity of the present invention.

Turning now to the drawings, and particularly to FIG. 1, there is illustrated one basic embodiment of the present invention constituting antenna array 20 (sometimes referred to herein simply as the antenna). Antenna 20 is formed of a polyethylene foam substrate 22 upon which various microwave circuit modules are deposited. In the embodiment illustrated herein, the microwave circuit modules are radiator elements 24 physically and electrically connected to feed conductors 26. The radiator elements are known as "patches"; and in the preferred embodiment each patch is formed as a square.

If it is assumed that antenna 20 is adapted to transmit or receive at a center frequency of $f_c$, then the wave length of the signal transmitted or received thereby is seen to be $\lambda=c/f$. Each radiator element is of substantially identical shape, and the side of each such square is substantially one-half the signal wave length, or $\lambda/2$. Preferably, all of the radiator elements are equally spaced from adjacent elements such that the spacing between antenna centers is represented as d and d is approximately between $0.7\lambda$ and $1\lambda$.

Radiator elements 24 are deposited on, for example, the top surface of polyethylene foam substrate 22 in an $n\times m$ array, and a ground plane is deposited on the bottom surface (not shown) of the substrate. The ground plane may be a conductive ink coated on the bottom surface of the substrate; or it may be formed as a plate or foil. Alternatively, the ground plane may be constituted by a conductive ink coated on a structural foam plastic support which is adhered to the bottom surface of substrate 22. Examples of such foam plastic are sold under the trademarks Lexan and Noryl. In the illustrated embodiment, $n=m$ and, for simplicity, radiator elements 24 are disposed in a $4\times4$ array. It will be appreciated that the size of the array may vary, as desired, and depending upon the intended applications of the antenna. However, for numerical simplicity, it is assumed that the example described herein is formed of a $4\times4$ array. Radiator elements 24 may be thought of as being arranged in $2\times2$ subarrays, with each subarray being connected by a conventional corporate feed network 28. As will be described, radiator elements 24, feed conductors 26 and corporate feed networks 28 all may be deposited on the top surface of substrate 22 in the same operation (e.g. by printing, silk screening, vacuum deposition, or other techniques to be described). If desired, the top surface of the substrate first may be coated with conductive material (as by the foregoing techniques) to provide a "seed" coating on which elements 24, conductors 26 and corporate feeds 28 may be deposited. This enhances the conductivity of the elements, conductors and corporate feeds.

In the illustrated example, each corporate feed network 28 is coupled to two column feed conductors 26, each column feed conductor connecting two radiator elements 24 in series. As an alternative, each corporate feed network 28 may be coupled to two row conductors; and each row conductor may connect two radiator elements 24 in series. Still further, and as will be described below, each column (or row) conductor 26 may connect four radiator elements 24 in series, and a single corporate feed network 28 may be used to connect all four columns (or rows) of radiator elements to an input/output (I/O) means. The purpose of the I/O means is to serve as a signal source to supply a signal to be transmitted to radiator elements 24 or, alternatively, to receive, for further processing, the signal received by the radiator elements.

Polyethylene foam substrate 22 has a loss tangent less than 0.001 and a dielectric constant less than 1.3. Examples of the materials which may be used as the polyethylene foam substrate now follow:

The substrate may be manufactured by Voltek Division of Sekisui America Corp. and sold under the trademarks Volaro, Minicel or Volasta. If the antenna is to be used in the L band, the thickness of this material may be on the order of 0.25 inches $\pm100$ mils. If the antenna is to be used in the C band, the thickness of the substrate is 0.125 inches $\pm50$ mils. If the antenna is to be used in the Ku band, the thickness of the substrate is on the order of 0.3125 inches $\pm25$ mils. The dielectric constant is on the order of about 1.05 and the loss tangent is on the order of 0.0002. The density of the polyethylene foam is 1.5 to 20 pounds per cubic foot. As an alternative, the thickness of the polyethylene foam may be on the order of 0.03125 inches $\pm7$ mils, for use in the Ku band, the dielectric constant is on the order of 1 and the loss tangent is on the order of 0.0002. The density of this thin substrate is on the order of 3 pounds per cubic foot. If the material is formed of Volasta, its thickness may be on the order of 1/32 inches to 1 inch for use throughout the L, C and Ku frequency bands. Here, the dielectric constant is approximately 1.2 with a loss tangent of 0.001 and a density of 10 pounds per cubic foot.

As another example, the polyethylene foam substrate may be manufactured by Sentinel Foam Products Company with a thickness having a multiple of 4 mils. The antenna formed of this material may be used throughout the L, C, Ku bands; and the polyethylene foam substrate has a dielectric constant of approximately 1.05 at 1 KHz and a loss tangent of $2.0\times10^{-4}$ at 28° C. and at a frequency of 1KHz. The density of this polyethylene material is 1.0–1.2 pounds per cubic foot. Alternatively, Rogers polyethylene may be used as the substrate, and this polyethylene may have a thickness of any desired multiple of 0.16 inches. The frequency band of the antenna formed of this material is throughout the L, C, Ku bands; and the polyethylene has a dielectric constant on the order of 2.1 and a loss tangent of approximately 0.0024. The density of this polyethylene is 6 pounds per cubic foot.

Other examples of polyethylene materials that may be used as substrate 22 include materials available from Halstead/Nomaco of Wynne, Ark. These materials include NP 1200 having a thickness of $\frac{3}{8}$ inches to $4\frac{1}{8}$ inches $\pm0.25$ mils. An antenna formed of this substrate operates throughout the L and C bands.

Radiator elements 24, feed conductors 26 and corporate feed networks 28 of FIG. 1 may be vacuum deposited on the top surface of substrate 22. If vacuum deposited, the radiator elements, the conductors and corporate feed networks may be formed of copper, gold, silver, aluminum or nickel. In the preferred embodiment, the radiator elements, feed conductors and corporate feed networks are formed of electrically conductive ink print or epoxy and are printed directly on the top surface of substrate 22. As an example, the conductive inks may be silk screened onto the surface of the substrate. Preferably, the electrically conductive inks include at least 40% by weight of a solid selected from the group consisting of silver, copper, nickel and graphite, and a liquid selected from the group consisting of epoxy resin, polyurethane, acrylic and thermoplastic solvent. Examples of suitable conductive inks are as follows:

Dupont type 4007 and 4008 polymeric compositions contain approximately 72% solids (silver) ±2%. This conductive ink may be applied by silk screen techniques and, depending upon the screen size, approximately 120–230 square centimeters per gram may be printed. The recommended curing temperature is 120° C. for five minutes and the resultant resistivity is on the order of 15 milliohms/square/mil.

Epotek Model H20F, manufactured by Epoxy Technology, Inc. of Billerica, Mass., is a two-component epoxy resin with hardener and may be cured at 150° C. for 10 minutes. The resultant resistivity is on the order of 1.3 milli- ohms/square/mil. Alternatively, Epotek type H20E epoxy resin with silver powder and a two-part hardener may be cured at 175° C. for 45 minutes, at 150° C. for 5 minutes, at 120° C. for 15 minutes, at 80° C. for 90 minutes and, finally, at 50° C. for 60 minutes, resulting in a resistivity on the order of 1 to 4 milliohms per centimeter.

Carroll Coating Type C-641 acrylic coating, manufactured by Carroll Coating Co. of Providence, R.I., may be printed at 75 square feet per pound of material, resulting in a resistivity of 0.02 ohms/square/mil when cured at 80° C. for 15 minutes. When Carroll Coating Type C-621 polyurethane is used, it may be printed at the rate of 75 square feet per pound of material, and results in a resistivity of 0.03 ohms/square/mil when cured at 80° C. for 30 minutes. The application of Carroll Coating Type C-605 Epoxy at the rate of 65 square feet per pound of material results in a resistivity of 0.04 to 0.07 ohms/square/mil when cured at 80° C. for 1 hour.

Heraeus Cermalloy Type 5450 thermoplastic, manufactured by Heraeus, Inc. of West Conshohocken, Pa., containing approximately 61% solids, may be applied at the rate of 125 square centimeters per gram of material and, when cured at 100° C. for 15 minutes, followed by 80° C. for 30 minutes, followed by 130° C. infrared curing for 3 minutes, results in a resistivity on the order of 9–30 milliohms/sq./mil. Type 5260 thermosetting material, containing 84.5% ±1 solids, applied at the rate of 65 centimeters per gram of material and cured at 150° C. for 30 minutes results in a resistivity less than 0.008 ohms. Heraeus Cermalloy Type AD-1608.05 air dry or thermoset conductive material, containing 60% silver ±1 solids and cured at 200° C. for 30 minutes results in aresistivity of about 8 milliohms/sq./mil. Type AD-1548.07, containing 54% silver ±1 and cured at 200° C. for 30 minutes results in a resistivity of about 8 milliohms/sq./mil. Type AD-1688.06 material, containing 68% silver ±1 solids and cured at 200° C. for 30 minutes results in a resistivity of about 8 milliohms/sq./mil.

Aremco Type 525 silver/epoxy, manufactured by Aremco Products, Inc. of Ossining, N.Y., the majority of whose solids are silver, and cured at 300° F. for 2 hours, 325° F. for 1½ hours and then 350° F. for 1 hour results in a resistivity of 10 milliohms-centimeters. When type 616 silver-silver matrix is used, and cured at room temperature for 16 hours, then 100° F. for 2 hours, then 200° F. for 1 hour and then 300° F. for ½ hour, a resistivity on the order of 18 milliohms-centimeters is obtained.

Other conductive inks which may be used to carry out the present invention are as follows:

| Manufacturer | Type | Composition | % Solids | Application | Curing | Resistivity |
|---|---|---|---|---|---|---|
| Thermoset Plastics, Inc. Indianapolis, Indiana | ME-138 | Electrically conductive, solvent-free, fast curing, epoxy adhesive with very low levels of ionic impurities (1 part) | 70% | 1.8 $m^2$/gm | 135° C. for 90 mins. 150° C. for 60 mins. 165° C. for 30 mins. | 0.0005 ohm-centimeters |
| Thermoset | ME-137 | Electrically conductive, silver filler, epoxy adhesive with low levels of ionic impurities (2 part) | 70% | 1.8 $m^2$/gm | 130° C. for 2 hrs. 150° C. for 1½ hrs. 180° C. for 1 hr. | 0.00005 ohm-centimerers |
| Thermoset | ME-135 | Electrically conductive, silver filler, epoxy adhesive with low levels of ionic impurities (1 part) | 70% | 1.8 $m^2$/gm | 130° C. for 2 hrs. 150° C. for 1½ hrs. 180° C. for | 0.00005 ohm-centimerers |

-continued

| Manufacturer | Type | Composition | % Solids | Application | Curing | Resistivity |
|---|---|---|---|---|---|---|
| Formulated Resins, Inc. Greenville, Rhode Island | 4000 | Semiconductor grade silver filled adhesive (1 part) | 76% silver | 250–300 ft.$^2$/gal. | 1 hr. 150° C. for 2 hrs. 150° C. for 1 hr. 75° C. for ½ hr. | 0.001 ohm-centimeters |
| Formulated Resins | 4020 | Semiconductor grade silver filled adhesive (2 part) | 73% silver | 250–300 ft.$^2$/gal. | 100° C. for 1 hr. 125° C. for ½ hr. 150° C. for 10 mins. | 0.001 ohm-centimeters |
| Formulated Resins | 4140 | High temperature resistant silver filled epoxy conductive adhesive (1 part) | 76% silver | 250–300 ft.$^2$/gal. | 125° C. for 2 hrs. 150° C. for 1 hr. 175° C. for ½ hr. | 0.001 ohm-centimeters |
| Formulated Resins | 4150 | Silver filled, room temperature curing, conductive epoxy adhesive polymer (2 part) | 75% silver | 250–300 ft.$^2$/gal. | room temperature for 24 hrs. 50° C. for 45 mins. 100° C. for 15 mins. | 0.001 ohm-centimeters |
| Formulated Resins | 4360 and 4361 | Flexible, screen-printable, silver conductive ink coating (1 part) | 60% silver | 250–300 ft.$^2$/gal. | 100° C. for 10–15 mins. | 0.015 ohm-centimeters |
| Formulated Resins | 4380 | Flexible, heat curing, screen printable silver conductive ink coating (2 parts) | 60% silver | 250–300 ft.$^2$/gal. | 120° C. for ½ hr. | 0.01 ohm-centimeters |
| Formulated Resins | 4443 and 4446 | Solderable, organci silver conductive polymer coating (1 part) | 43% and 46% silver | 250–300 ft.$^2$/gal. | room temperature for 10–30 mins. 125° C. for 1 hr. | 0.0001 ohm-centimeters |
| Formulated Resins | 4450 and 4470 | High temperature resistant organic silver conductive coating (1 part) | 50% to 70% silver | 250–300 ft.$^2$/gal. | 175° C. for 1 hr. 175° C. or 2–8 hrs. 120° C. for 1 hr. 175° C.–200° C. for 1–2 hrs. | 0.0002 ohm-centimeters and 0.0001 ohm-centimeters |
| Amicon | CT-5207 | Thermoplastic silver filled, heat cured, solvent based conductive coating and ink (2 parts) | 50% to 70% silver | 180 square centimeters per gram (wet) | 80° C. for 1 hr. 90° C. for 30 mins. 100° C. | less than 0.01 ohms/sq. mil. |

-continued

| Manufacturer | Type | Composition | % Solids | Application | Curing | Resistivity |
|---|---|---|---|---|---|---|
| | | | | | for 10 mins. | |
| Ablestik Laboratories, Garden, CA. | Ablebond 84-1LMITI | Ultrahigh thermal conductivity solvent-free electrically conductive hybrid chip attachment adhesive | 75% | squeezed on from applicator | 125° C. for 2 hrs. 150° C. for 1 hr. | .3 milliohm per centimeter |
| Acheson Colloid Co. Port Huron, Michigan | 423SS | Graphite based polymer thick film ink | 36% silver | 370 sq. mils/gram | 71° C. for 30 mins. 93° C. for 15 mins. 121° C. for 5 mins. | greater than 50 ohms/sq./mil |
| Acheson Colloid | 550 | Easy mixing stable highly silver conductive nickel coating | 59.5% mils/gram | 405 sq. temp. | room ohms/sq.-/mil for 5 mins. | less than 0.5 |
| Acheson Colloid | 440 | Highly conductive nickel coating | 69.8% | 500 sq. ft./gal. | room temp. for 5 mins. | less than one ohm/sq./mil |
| Acheson Colloid | 415C | Economical fast drying silver conductive coating | 62% silver | 265 sq. mils/gm. | air dry for 10 mins. | 0.04–0.07 ohms/sq./mil |
| Acheson Colloid | 437 | Stable highly conductive copper coating | 63.5% copper | 510 sq. mils/gm. | room temp. for 5 mins. | less than 0.5 ohms/sq./mil |
| Acheson Colloid | 427SS | Silver based polymer thick film ink | 77% silver | 626 sq. mils/gm. | 71° C. for 30 mins. 93° C. for 15 mins. 121° C. for 5 mins. | at least 0.075 ohms/sq./mil |

As mentioned previously, in the preferred embodiment of the present invention, polyethylene foam substrate 22 upon which radiator elements 24, feed conductors 26 and corporate feed networks 28 are deposited, as by silk screen techniques using the conductive inks referred to above, may constitute one of several separate panels which, when combined to form an integral structure, constitute the overall antenna. Although a single panel may be used, as shown in FIG. 1, providing an n×m (e.g. 4×4) array, FIGS. 2 and 3 schematically illustrate the manner in which the overall integral antenna structure may be formed by interconnecting individual panels. As shown in FIG. 2, polyethylene foam substrate 22 comprises one of these panels and is provided along at least one edge thereof with a plurality of tongues 32. These tongues may be formed integrally with the foam substrate and, preferably, constitute several, individual tongue-like projections. Alternatively, these several projections may be replaced by a single tongue-like projection disposed along a significant length of the edge of the substrate.

As shown in FIG. 3, tongues 32, which project outwardly from one side edge of one panel 22, are adapted to be received and retained by a mating groove 34 which is formed in the opposite side edge of yet another panel 22. By fitting tongue 32 into groove 34, two substantially identical panels may be arranged in side-by-side configuration. For uniformity and ease of manufacture, it will be appreciated that each panel 22 thus may be provided with tongues 32 projecting from, for example, the right side edge thereof, and each such panel also may be provided with a mating groove 34 disposed along the left side edge thereof. Still further, in order to form a larger array, the bottom edge of each panel 22 may be provided with similar tongues (not shown) and the top edge likewise may be provided with a mating groove (also not shown). Thus, successive panels may be arranged in a row, and additional panels also may be arranged in column form. By reason of this mating tongue and groove structure, an array of 2×2, 3×3, 4×4, etc. panels may constitute the overall antenna.

In the embodiment wherein a 2×2 panel array, for example, is constructed, it is appreciated that a common point is provided at the intersection of all four panels. In the preferred embodiment, and as shown in FIG. 2, each panel is provided at its intersecting corner with an arcuate quadrant-shaped cutout 36. When all four panels are interconnected, the four arcuate quadrant cutouts result in a circular opening which, as will be described, is adapted to receive a circular feed conductor which connects to the feed conductors and corporate feed networks on each panel.

In the embodiment shown in FIG. 2, radiator elements 24 on substrate 22 are illustrated as being connected in series by respective column conductors 30. As an alternative, or as an addition, radiator elements 24 may be connected in series to form respective rows by means of row conductors 50 (shown in FIG. 5).

Turning to FIG. 4, a schematic representation of the manner in which a 2×2 panel array is formed to constitute a multi-panel array 40 is illustrated. Individual polyethylene foam panels 42*a*, 42*b*, 42*c* and 42*d*, each similar to polyethylene foam substrate 22 (FIGS. 2 and 3) may be interconnected by the tongue and groove arrangement shown particularly in FIG. 3. An n×m array of radiator elements 24 is formed on each panel, although only the array of radiator elements formed on panel 42*a* is illustrated. Column conductors 30 serve to interconnect in series relationship the radiator elements in each column; and the column conductors are fed by means of a corporate feed network 28. As a numerical example, and consistent with the examples discussed above, four columns of radiator elements 24, with four elements provided in each column, are deposited on each polyethylene foam panel 42. Of course, a greater (or lesser) number of columns and of radiator elements can be used, as desired.

An input/output circuit 44 (referred to simply as an I/O circuit) is connected to all of corporate feed networks 28 on each panel 42*a*–42*d* by means of conductors 46. As will be appreciated by those of ordinary skill in the art, I/O circuit 44 is spaced equidistantly from each corporate feed network 28 such that the length of each conductor 46 from the I/O circuit to a respective corporate feed network is constant. Thus, the resistance (and, consequently, the loss) from I/O circuit 44 to each corporate feed network is equal. Hence, each radiator element 24 is supplied with a signal of substantially the same magnitude. Of course, for certain transmission/-reception purposes, it may be desired to supply the respective radiator elements with signals of different magnitudes. This may be achieved by providing patterns of microwave circuit modules that exhibit a tapered configuration, thereby providing an amplitude taper in the signals supplied to these radiator elements. Still further, and as will be described below, the signals supplied to the respective columns of radiator elements (or to respective rows of radiator elements) may exhibit different phases for the purpose of providing beam steering in the direction (or "illumination") of the radiant energy beams emitted by each antenna panel.

Figure 5:
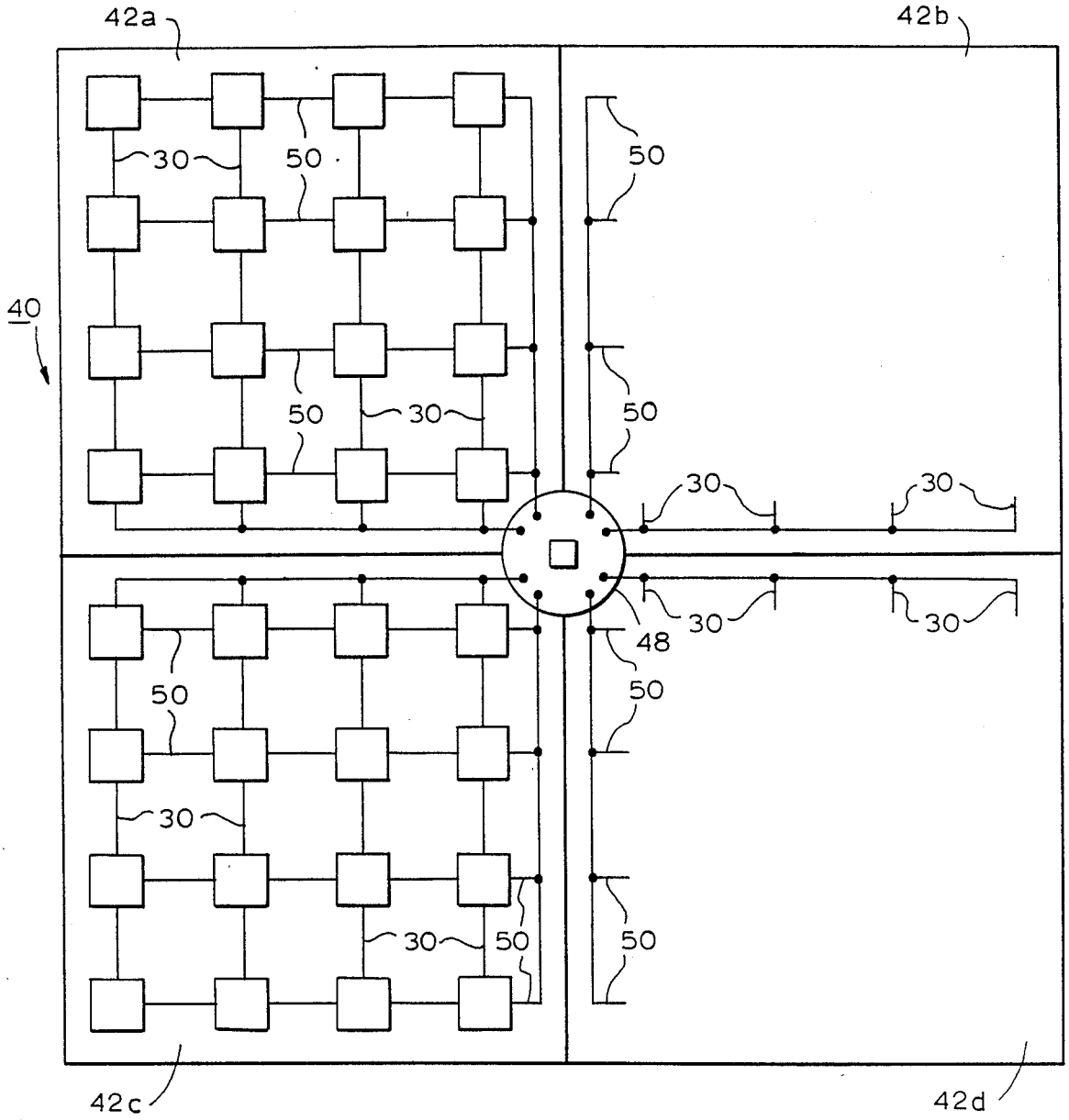

FIG. 5 is yet another schematic representation of the manner in which an overall 2×2 panel array is formed of polyethylene foam panels 42*a*–42*d*. As before, these panels may be interconnected by the tongue and groove arrangement shown in FIGS. 2 and 3. FIG. 5 particularly illustrates the use of a circular feed conductor 48, which may be formed of a copper plate or other disk of suitably conductive material, disposed in the opening formed by the combination of arcuate shaped cutout quadrants 36 of the interconnected panels. The conductor 48 is provided with, for example, an SMA connector on its reverse side (not shown) to be supplied with a signal from a suitable source (or, alternatively, to feed a received signal to a central processing arrangement); and the feed conductor also is provided with OSP type snap fit connectors for the purpose of connecting radiator elements 24 thereto. A pair of OSP type connectors is provided on feed conductor 48 in the vicinity of a respective one of panels 42*a*–42*d*. Each connector included in a respective pair functions to connect a column or row of radiator elements 24 in series. For example, and as shown more particularly with respect to panel 42*a*, four column conductors 30 form four separate columns of series-connected radiator elements, and the four column conductors are, in turn, connected to a single OSP type connector on feed conductor 48. Likewise, four separate row conductors 50 form four rows of radiator elements 24, each row including four series-connected elements. These four row conductors 50 are, in turn, connected to a single OSP type connector on feed conductor 48. Thus, one OSP type connector feeds all four columns of radiator elements provided on panel 42*a* and another OSP type connector feeds all four rows of these radiator elements. Similarly, yet another OSP type connector feeds all four columns of radiator elements provided on panel 42*b*, while a still further OSP type connector feeds all four rows of series-connected radiator elements on this panel 42*b*. Similar connections are provided between feed conductor 48 and the remaining panels. By reason of the illustrated geometry, it is appreciated that feed conductor 48 is equidistant from the column and row conductors on each of panels 42*a*–42*d* and, thus, conductive paths of equal length are traversed by the signals from the feed conductor to the respective radiator elements.

FIG. 6 is a schematic representation of the manner in which the radiator elements included on, for example, a respective one of panels 42*a*–42*d* are connected to an I/O signal source for the purpose of achieving beam steering of the radiant energy transmitted (or received) by this panel. Although FIG. 6 represents the interconnection of the I/O signal source to the radiator elements of a single panel, it will be appreciated that the I/O source may be similarly connected to the radiator elements of all of the remaining panels discussed previously with respect to FIGS. 4 and 5.

I/O source 56 is coupled to radiator elements 24 by means of column and row phase shifting circuits 52 and 54, respectively. More particularly, each column of radiator elements 24 is connected in series with a respective one of column phase shifters 52 by means of column conductors 30 and, similarly, each row of radiator elements is connected to a respective one of row phase shifters 54 by means of row conductors 50. This differs from typical prior art phased arrays in which a separate phase shifter is connected to one and only one radiator element. Here, however, the output of a phase shifter is connected to a series-connected row or column of radiator elements. A corporate feed network connects all of the column phase shifters to a respective terminal (shown as the horizontal terminal H) of a switch 58; and a similar corporate feed network connects all of the row phase shifters to another terminal (shown as the vertical terminal V) of this switch. I/O signal source 56 is connected to switch 58 and, by reason of the operation of this switch, the source is connected either to the column phase shifters 52 or to the row phase shifters 54. Depending upon which of the phase shifters is connected to I/O source 56, a corresponding horizontal or vertical (e.g. left-right or top-bottom) beam steering is electronically achieved. For example, if radiator elements 24 may be thought of as being disposed in a vertical plane (that is, if it is assumed that polyethylene foam substrate 22 is supported in the vertical plane), then, by connecting source 56 to column phase shifters 52, the directivity of the radiant energy beam, or illumination of antenna 20, may be controlled in a horizontal plane. Conversely, by connecting I/O source 56 to row phase shifters 54, the direction of this antenna beam may be electronically steered in a vertical plane. Of course, by combining the operation of column and row phase shifters 52 and 54, as by connecting the row and column phase shifters in common to source 56, a two-dimensional steering of the antenna beam may be achieved.

Let it be assumed that I/O source 56 is connected by switch 58 to column phase shifters 52. If each of the phase shifting circuits is set to provide an equal phase shift to the signal supplied thereto, the antenna beam direction, or illumination, is substantially orthogonal to the plane of the antenna. However, if different phase shifts are imparted by each of column phase shifters 52, a change, or shift, in the direction of the antenna beam is achieved. Such beam steering changes are represented by the graphs shown in FIGS. 6A–6D, these graphs depicting the direction of the major radiation pattern together with significant side lobes thereof. FIG. 6A represents the beam steering direction when equal phase shifts are imparted by column phase shifters 52; and FIGS. 6B–6D represent the beam steering direction arising out of different phase shifts imparted by these phase shift circuits.

Although not shown or described specifically herein, it will be appreciated that similar beam steering effects are achieved as a function of the phase shifts imparted by row phase shifters 54 when switch 58 connects I/O source 56 to these row phase shifters. Thus, the graphical representations depicted in FIGS. 6A–6D may represent the horizontal beam steering directions when switch 58 connects source 56 to the column phase shifters; and these same graphical depictions represent the vertical beam steering directions arising out of the phase shifts imparted by row phase shifters 54 when switch 58 connects I/O source 56 to these row phase shifters.

It will be recognized that the aforementioned beam steering technique is effective in "pointing" the antenna to a desired satellite which might not be stationary. Likewise, by electronically steering the antenna illumination, precise physical "pointing" of the antenna to a desired location or along a desired direction is not necessary. Adjustments can be made electronically to obtain more precise (i.e. fine) antenna "pointing". Still further, if the antenna is mounted on a moving vehicle, such as a ship, aircraft, or the like, changes in the position of the antenna caused by movement of the vehicle, such as the rolling of a ship, can be compensated by electronically steering the antenna illumination. For example, the rolling of a ship can be detected and such rolling motion may be electronically fed back to phase shifters 52 and 54 so as to compensate for such rolling and, thereby, maintain a substantially constant direction in antenna illumination.

FIG. 7 is a schematic representation of a circuit 70 for providing the requisite control voltages to establish the desired phase shift for each of phase shifters 52. Thus, the phase shift produced by, for example, phase shifting circuit **52*a* is determined by control voltage $V_a$ applied thereto; the phase shift produced by phase shifting circuit 52*b* is determined by control voltage $V_b$; the phase shift produced by phase shifting circuit 52*c* is determined by control voltage $V_c$, and so on. It is appreciated that phase shifting circuits 52*a*, 52*b*, 52*c* . . . are included in phase shifters 52**.

Circuit 70 of FIG. 7 is comprised of cascaded voltage dividers, the output of each voltage divider producing a respective control voltage $V_a$, $V_b$, $V_c$, . . . ; and phase shifting circuits **52*a*, 52*b*, 52*c*. . . being connected in series with the cascaded voltage dividers. An input terminal 72 supplies an input phase control voltage which is divided by the voltage divider formed of resistors 74 and 76 to apply control voltage $V_a$ to phase shifting circuit $52_a$. A voltage is provided at the output of phase shifting circuit 52*a* and is divided by the voltage divider formed of resistors 78 and 80 to apply control voltage $V_b$ to phase shifting circuit 52*b*. Likewise, the voltage provided at the output of phase shifting circuit 52*b* is divided by the voltage divider formed of resistors 82 and 84 to apply control voltage $V_c$ to phase shifting circuit 52*c*. This voltage division operation continues to produce the remaining control voltages $V_d$ . . . . Thus, different phase shifts are imparted by phase shifting circuits 52*a*, 52*b*, 52*c***, . . . in response to control voltages V*a*, V*b*, V*c*. . . to change the direction of the antenna beam. A circuit similar to circuit 70 is used to apply phase shift control voltages to the phase shifting circuits included in phase shifters 54.

Turning now to FIG. 8, there is illustrated yet another embodiment of an antenna array 20, this array being shown in sectional form. Here, polyethylene foam substrate 22 is provided with a ground plane 60 which may be formed of aluminum, nickel, copper or silver. For convenience of description, the ground plane may be thought of as being applied to the bottom, or reverse, surface of substrate 22; and radiator elements 24 are deposited on the top surface of the substrate. More particularly, radiator elements 24, which may be formed in the manner described above, such as by silk screen printing techniques, are deposited upon a plastic layer 62 which, in turn, is adhered to the top surface of substrate 22. Plastic layer 62 may be formed of suitable plastic film materials, such as type 5500, manufactured by GTS, which is formed of copper and a polyester, and exhibits a thickness of 5 mils ±10%. Copper is present in the amount of 1%; and the polyester, which may be of the pre-shrunk type is present in the amount of 3 mils.

Other suitable plastic films include Kevlar 49, manufactured by du Pont, which is an aromatic polyamide formed with a very rigid molecular chain. Other plastic films include those manufactured by Allied Resinous Products, such as Type A, a low density polyethylene, Type F, a high density polyethylene, Type O, a polypropylene, and Styruwol, a high impact styrene. Other examples of plastic films are manufactured by American Hoechst Corporation, including Hostalen GUR, a high density, linear polyethylene of very high molecular weight. Other manufacturers of suitable plastic films include Van Leer Corporation, which manufactures Type ULHP-COP, a high performance copolyester film, Type VLHP-PVC-RW, a high performance rigid white PVC film, Type VLHP-PVC-RC, a high performance rigid clear PVC film, and Valeron films, Type VLCP-2.5, -3, -3.5, -4 and -5, all oriented and cross-laminated film with outstanding strength, elongating and barrier characteristics. Van Leer also manufactures Type Monax H DPE high density polyethylene monopoly substrates, ranging in thickness from 0.5 mils to 2.5 mils. Other manufacturers of suitable plastic films include General Electric, manufacturer of Lexan Type CF, a one-side flexible hard-coated polycarbonate film with outstanding abrasion and chemical resistance, Type 8800-112, a clear thin gauge polycarbonate film on the order of 0.0005–0.005 inches, and Type FR, a flame retardant polycarbonate film of a thickness 0.001 to 0.030 inches. Still another suitable plastic film is manufactured by Homayte Corporation, including Type H-911, a rigid alkyl diglycol carbonate having excellent optical, scratch and chemical resistance characteristics, Type H-100, a thermosetting polyester, Type H-101, another thermosetting polyester and Type H-141, yet another thermosetting polyester. A saturated polyester, a polyester with unsaturated acid components or a polyester with unsaturated alcohol components may be used. Likewise, an ethylene glycol terephthalic acid polyester, such as Mylar manufactured by DuPont, or a polyimide such as Kapton, also manufactured by DuPont may be used.

It is appreciated that radiator elements 24 may be printed or otherwise deposited directly on one surface of plastic film 62 and a suitable adhesive, such as cement, may be used to adhere the plastic film to the top surface of substrate 22. As shown in FIG. 9, the surface of plastic film 62 on which radiator elements 24 are deposited may be adhered to the top surface of substrate 22, thereby sandwiching the radiator elements between the substrate and the film and providing environmental protection to the radiator elements by reason of the inherent protective characteristics of the plastic film itself. In this embodiment, antenna array 20 may be thought of as being formed as an inverse microstrip.

Turning to FIG. 10, radiator elements 24 may be deposited on one surface of plastic film 62 while phase shifting circuits 52 and 54 may be deposited on the other surface of the plastic film. Then, the film may be cemented to the top surface of substrate 22, either by sandwiching the radiator elements or by sandwiching the phase shifting circuits between the plastic film and, the substrate. FIG. 10 is representative of the overall technique which can be used to print both radiator elements and phase shifting circuits onto plastic film 62 by means of silk screen techniques or other conventional printing techniques. Once printed with the radiator elements and phase shifting circuits, that is, once printed with the microwave circuit module patterns, plastic film 62 simply is adhered to the top surface of substrate 22.

From the foregoing, it is appreciated that plastic layer 62 may be formed of a polyethylene, a polypropylene, a styrene, a polyvinyl chloride, a thermosetting polyester, a polycarbonate, a diglycol carbonate or an aromatic polyamide. The plastic films available from the aforementioned manufacturers are of these types.

In the embodiment of FIG. 10 wherein radiator elements 24 are provided on one surface of plastic layer 62 and phase shifters 52, 54 are provided on the opposite surface thereof, suitable feed through means may be provided to achieve electrical interconnection between the radiator elements on one surface and the phase shifters on the other. A suitable technique for achieving this through-connection would be recognized by one of ordinary skill in the art after reading U.S. Pat. No. 4,479,991.

Figure 11:
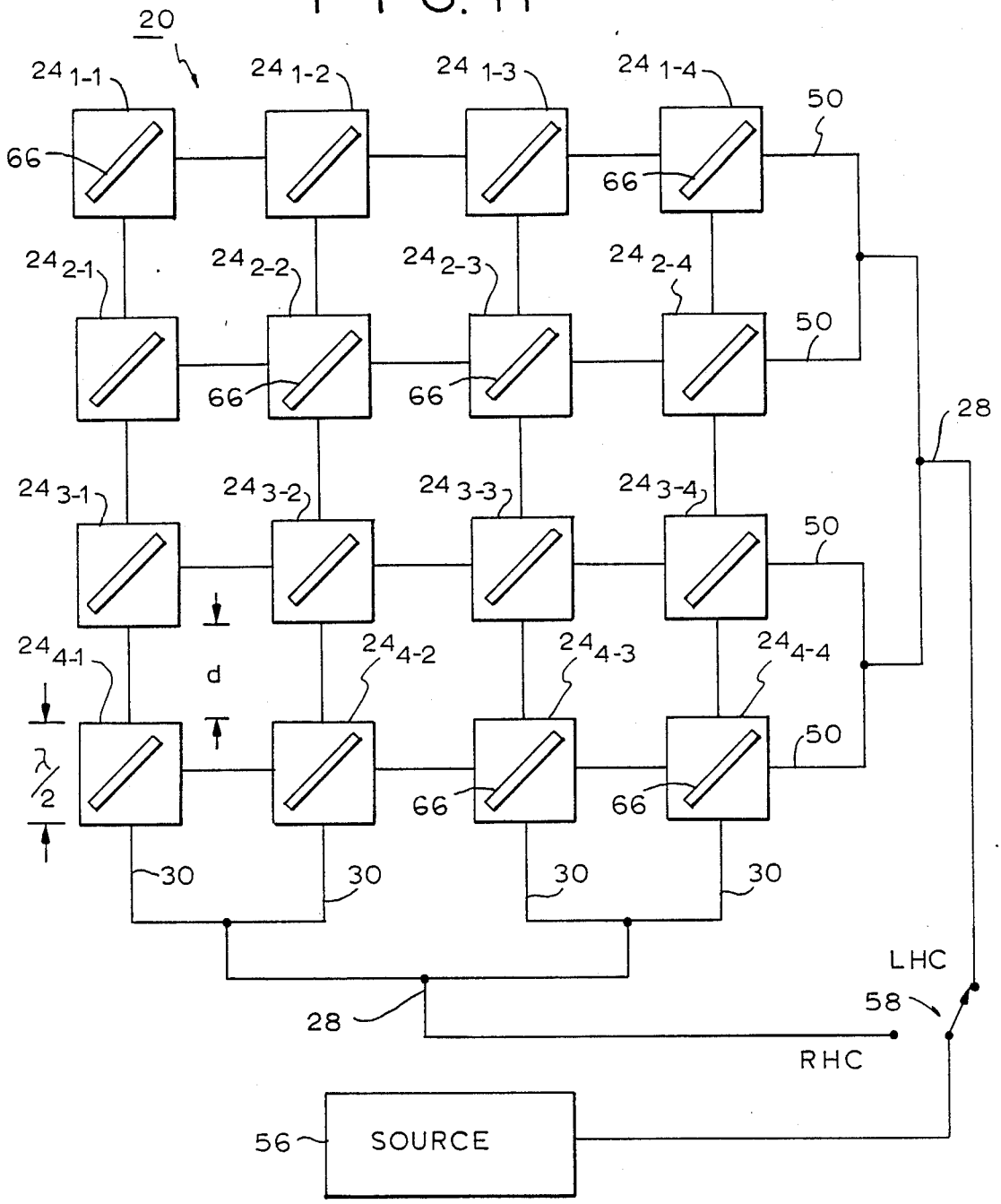
FIG. 11 is a schematic representation of an embodiment which permits circular polarization of the transmit/receive beam of the antenna formed by the present invention.

Referring now to FIG. 11, there is schematically illustrated a further embodiment of the present invention which achieves circular polarization of the radiant energy transmitted/received by antenna array 20. It will be appreciated that a multi-panel array, similar to that shown in FIGS. 4 and 5, may be used; but for convenience, only a single one of such panels is illustrated. As before, radiator elements 24 are disposed in an $n \times m$ array, such as a $4 \times 4$ array, with columns of elements connected by column conductors 30 to a corporate feed network 28 and, similarly, with rows of radiator elements connected by row conductors 50 to yet another corporate feed network 28. A switch 58, similar to aforedescribed switch 58 (shown in FIG. 6) is used to connect an I/O source 56 either to the rows of radiator elements or to the columns of radiator elements.

In the illustrated embodiment, each radiator element is provided with a diagonal slit 66. Preferably, this slit is formed as a rectangular slit; but other geometric configurations may be used, such as an ellipse. Each slit 66 is arranged along a diagonal so as to form an angle of, for example, $+45°$ with respect to column conductors 30. This same slit is seen to form an angle of $-45°$ with respect to row conductors 50.

When switch 58 is positioned to connect I/O source 56 to column conductors 30, the polarization pattern of the radiant energy transmitted by antenna array 20 is the so-called right-hand circular polarization pattern. Conversely, when switch 58 is positioned to connect I/O source 56 to row conductors 50, antenna array 20 emits radiant energy in the so-called left-hand circular polarization pattern.

Thus, by providing diagonal slit 66 in each radiator element and, further, by supplying a signal for transmission along conductors which are disposed at $+90°$ or $-90°$ with respect to this slit, right-hand circular polarization or left-hand circular polarization may be attained.

While the present invention has been particularly shown and described with reference to certain preferred embodiments, it will be appreciated by those of ordinary skill in the art that various changes and modifications may be made without departing from the spirit and scope of the invention. In addition to the electrically conductive inks and silk screening techniques which have been described above, the radiator elements, conductors, corporate feed networks and phase shifting circuits may be printed using other screen-printable conductive compositions, such as described in U.S. Pat. No. 4,371,459. Also, in addition to silk screen printing techniques, offset printing is contemplated by the present invention.

In addition to printing the microwave circuit modules onto substrate 22 (or plastic layer 62) as described above, the radiator elements, conductors, corporate feed networks and phase shifting circuits may be deposited by vacuum deposition techniques known to those of ordinary skill in the art. Still further, conventional stamping techniques may be used to form and apply the microwave circuit modules onto the polyethylene foam substrate.

The present invention attains an aesthetic advantage in that the actual patterns forming the microwave circuit modules can be formed of inks and other conductive materials which are relatively unobtrusive. Desirable images, prints or patterns may be formed on the top surface of substrate 22, these images, prints or patterns having a desirable aesthetic appearance thereby substantially concealing the actual antenna array.

Furthermore, by using the phase shifting circuits with suitable feedback arrangements, a substantially constant direction in antenna illumination can be achieved notwithstanding shifts in the position of the antenna itself. This permits the antenna to be mounted on a moving vehicle, as mentioned above, yet maintain the desired "pointing" of that antenna.

By providing a relatively low cost and lightweight substrate, and by permitting the various microwave circuit modules to be deposited on that substrate by fast, low cost manufacturing techniques, the overall cost of manufacturing and assembling the antenna of the present invention is significantly reduced.

It is intended that the appended claims be interpreted as including not only the embodiments specifically shown and described herein, but equivalents thereto now known or subsequently developed by those of ordinary skill in the art.

What is claimed is:

1. An antenna array comprised of:

a polyethylene foam substrate having a loss tangent less than 0.001 and a dielectric constant less than 1.3;

an array of n×m radiator elements formed of electrically conductive material deposited on a first surface of said substrate;

a feed network formed of electrically conductive material deposited on said first surface of said substrate for electrically interconnecting said radiator elements in said array;

I/O means coupled to said feed network for supplying a signal to be transmitted by said antenna array or for receiving a signal received by said antenna array; and a ground plane of conductive material deposited on a second surface of said substrate.

2. The antenna array of claim 1 further comprising a plastic layer, said array of radiator elements being deposited on said plastic layer and said plastic layer being adhered to said first surface of said substrate.

3. The antenna of claim 2 wherein said plastic layer is selected from the group consisting of polyethylene, polypropylene, styrene, polyvinylchloride, thermosetting polyester, polycarbonate, diglycol carbonate, aromatic polyamides, saturated polyester, polyester with unsaturated acid components, polyester with unsaturated alcohol components, and polyimides.

4. The antenna array of claim 1, 2 or 3 wherein said radiator elements and said feed network are formed of electrically conductive ink.

5. The antenna array of claim 4 wherein said electrically conductive ink includes at least 40% by weight of a solid selected from the group consisting of silver, copper, nickel and graphite.

6. The antenna array of claim 5 wherein said electrically conductive ink includes a liquid selected from the group consisting of epoxy resin, polyurethane, acrylic and thermoplastic solvent.

7. The antenna array of claim 1, 2 or 3 wherein said radiator elements and said feed network are vacuum deposited on said first surface of said substrate or on said plastic layer, respectively.

8. The antenna array of claim 1, 2 or 3 wherein said radiator elements are all of substantially the same dimensions and are substantially square in shape.

9. The antenna array of claim 8 wherein said feed network includes respective column conductor means for electrically interconnecting said radiator elements in respective columns.

10. The antenna array of claim 9 wherein said feed network additionally includes respective row conductor means for electrically interconnecting said radiator elements in respective rows.

11. The antenna array of claim 10 further comprising switch means for selectively coupling said I/O means to the respective columns or to the respective rows of radiator elements.

12. The antenna array of claim 7 wherein said radiator elements and said feed network are comprised of copper.

13. The antenna array of claim 7 wherein said radiator elements and said feed network are comprised of silver.

14. The antenna array of claim 1 wherein said ground plane is selected from the group consisting of copper, silver, aluminum and nickel.

15. The antenna array of claim 2 wherein said array of radiator elements is sandwiched between said substrate and said plastic layer.

16. The antenna array of claim 1 further comprising a layer of conductive material on said first surface of said substrate on which said radiator elements and said feed network are deposited.

17. An antenna array comprised of:

a polyethylene foam substrate having a loss tangent less than 0.001 and a dielectric constant less than 1.3;

an array of n×m radiator elements formed of electrically conductive material deposited on a first surface of said substrate;

a feed network formed of electrically conductive material deposited on said first surface of said substrate for electrically interconnecting said radiator elements in said array; said feed network including respective column conductor means for electrically interconnecting said radiator elements in respective columns and respective row conductor means for electrically interconnecting said radiator elements in respective rows;

said radiator elements including a diagonal slit therein at an angle approximately 45° to said column conductor means and to said row conductor means for transmitting a circularly polarized signal when a signal to be transmitted is supplied thereto by said column conductor means or by said row conductor means;

I/O means coupled to said feed network for supplying a signal to be transmitted by said antenna array or for receiving a signal received by said antenna array; and a ground plane of conductive material deposited on a second surface of said substrate.

18. The antenna array of claim 17 further comprising switch means for selectively coupling said I/O means to said column conductor means for the transmission of a signal circularly polarized in a first direction; said switch means selectively coupling said I/O means to said row conductor means for the transmission of a signal circularly polarized in a second, opposite direction.

19. An antenna array comprised of:

a polyethylene foam substrate having a loss tangent less than 0.001 and a dielectric constant less than 1.3;

an array of n×m radiator elements formed of electrically conductive material deposited on a first surface of said substrate;

a feed network formed of electrically conductive material deposited on said first surface of said substrate for electrically interconnecting said radiator elements in said array, said feed network including respective column conductor means for electrically interconnecting said radiator elements in respective columns;

and wherein adjacent radiator elements are separated from each other by a distance equal approximately to $\lambda/2$;

a feed network formed of electrically conductive material deposited on said first surface of said substrate for electrically interconnecting said radiator elements in said array;

I/O means coupled to said feed network for supplying a signal to be transmitted by said antenna array or for receiving a signal received by said antenna array; and a ground plane of conductive material deposited on a second surface of said substrate.

20. The antenna array of claim 19 further including means for varying the phase shifts of said phase shift means by different amounts, thereby electronically steering the beam directivity of said antenna array.

21. The antenna array of claim 20 wherein said means for varying the phase shifts of said phase shift means comprises a source of phase control voltage; plural cascaded voltage divider means coupled to said source to produce respective control voltages; and means for applying said respective control voltages to each phase shift means.

22. The antenna array of claim 21 further comprising a plastic layer, said array of radiator elements and said feed network being deposited on one surface of said plastic layer, said phase shift means being deposited on another surface of said plastic layer, connecting means for connecting said phase shift means to said feed network, and said plastic layer being adhered to said first surface of said substrate.

23. An antenna array comprised of:

a polyethylene foam substrate having a loss tangent less than 0.001 and a dielectric constant less than 1.3;

an array of $n \times m$ radiator elements formed of electrically conductive material deposited on a first surface of said substrate, said radiator elements are all of substantially the same dimensions and are substantially square in shape, the length of the side of each radiator element being substantially equal to one-half the wavelength of the signal transmitted or received by said antenna array and wherein adjacent radiator elements are separated from each other by a distance equal approximately to $\lambda/2$;

a feed network formed of electrically conductive material deposited on said first surface of said substrate for electrically interconnecting said radiator elements in said array;

I/O means coupled to said feed network for supplying a signal to be transmitted by said antenna array; and a ground plane of conductive material deposited on a second surface of said substrate.

24. The antenna array of claim 23 wherein $n=m$.

25. The antenna array of claim 24 wherein said feed network comprises a corporate feed arrangement.

26. A microwave circuit module comprising:

a polyethylene foam layer having a loss tangent less than 0.001 and a relative dielectric constant less than 1.3;

a predetermined pattern formed of conductive material provided on one surface of said polyethylene foam layer; and an electrically conductive ground plane secured to the opposite layer of said polyethylene foam layer.

27. The microwave circuit module of claim 26 further comprising a plastic sheet disposed on said one surface of said polyethylene foam layer, and wherein said predetermined, pattern is disposed on said plastic sheet.

28. The microwave circuit module of claim 26 or 27 wherein said predetermined pattern is formed of conductive ink comprised of solids containing at least 40% silver by weight.

29. A method of forming microwave components comprising the steps of:

providing a predetermined conductive pattern on one surface of a polyethylene foam layer having a loss tangent less than 0.001 and a relative dielectric constant less than 1.3; and securing the other surface of said polyethylene foam layer to an electrically conductive ground plane.

30. The method of claim 29 wherein said step of providing a predetermined conductive pattern comprises silk screen printing said pattern directly on said one surface of said polyethylene foam layer with a conductive ink comprised of solids containing at least 40% silver by weight.

31. The method of claim 29 wherein said step of providing a predetermined conductive pattern comprises printing said pattern on a plastic sheet with a conductive ink comprised of solids containing at least 40% silver by weight, and adhering said sheet to said one surface of said polyethylene foam layer.

* * * * *